US009487367B2

(12) United States Patent
Otsuki

(10) Patent No.: US 9,487,367 B2
(45) Date of Patent: Nov. 8, 2016

(54) IMAGE FORMING APPARATUS

(71) Applicant: Yasuyuki Otsuki, Nagoya (JP)

(72) Inventor: Yasuyuki Otsuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/013,486

(22) Filed: Aug. 29, 2013

(65) Prior Publication Data

US 2014/0062007 A1 Mar. 6, 2014

(30) Foreign Application Priority Data

Aug. 29, 2012 (JP) ..... 2012-188598

(51) Int. Cl.

| | |
|---|---|
| ***B65H 5/06*** | (2006.01) |
| ***B65H 9/00*** | (2006.01) |
| ***G03G 15/00*** | (2006.01) |
| ***G03G 21/00*** | (2006.01) |

(52) U.S. Cl.

CPC ..... *B65H 5/062* (2013.01); *B65H 9/006* (2013.01); *G03G 15/6561* (2013.01); *G03G 21/00* (2013.01); *B65H 2301/5115* (2013.01); *B65H 2404/6111* (2013.01); *B65H 2801/09* (2013.01); *G03G 2221/0042* (2013.01)

(58) Field of Classification Search

CPC B65H 5/062; B65H 9/06; B65H 2301/5115; B65H 2404/6111; G03G 21/00; G03G 15/6561

USPC ..... 271/272–274, 264; 399/390, 98

See application file for complete search history.

(56) References Cited

U.S. PATENT DOCUMENTS

| | | | | |
|---|---|---|---|---|
| 5,351,108 | A | 9/1994 | Mizutani | |
| 5,692,747 | A * | 12/1997 | Guerrero et al. | 271/296 |
| 5,740,498 | A | 4/1998 | Tsuchiya | |
| 6,219,505 | B1 | 4/2001 | Sato et al. | |

(Continued)

FOREIGN PATENT DOCUMENTS

| | | |
|---|---|---|
| JP | 3-115030 A | 5/1991 |
| JP | 06-336348 A | 12/1994 |

(Continued)

OTHER PUBLICATIONS

Non-Final Office Action received in related U.S. Appl. No. 13/359,622 mailed Apr. 23, 2014.

(Continued)

*Primary Examiner* — Ernesto Suarez
(74) *Attorney, Agent, or Firm* — Banner & Witcoff, Ltd.

(57) ABSTRACT

An image forming apparatus has an image forming unit, a sheet supplying unit, a register roller, and a paper particle removing unit which includes a paper particle removing roller arranged to face the register roller and configured to collect paper particles on the sheet which is nipped between the register roller and the paper particle removing roller, a paper particle container configured such that the paper particles removed by the paper particle removing roller are accumulated therein, and an auger arranged inside the paper particle container. The paper particle removing roller, the paper particle container and the auger of the paper particle removing unit are configured to move together between a contact position where the paper particle removing roller contacts the register roller and a spaced position where the paper particle removing roller is spaced from the register roller.

9 Claims, 7 Drawing Sheets

(56) References Cited

U.S. PATENT DOCUMENTS

| | | | | |
|---|---|---|---|---|
| 6,415,119 | B2 | 7/2002 | Nishimura et al. | |
| 6,505,019 | B2 | 1/2003 | Sato et al. | |
| 6,708,009 | B2 | 3/2004 | Fuwazaki et al. | |
| 7,149,455 | B2 | 12/2006 | Hattori | |
| 7,149,456 | B2 | 12/2006 | Yamagata | |
| 7,496,316 | B2 * | 2/2009 | Ito et al. | 399/122 |
| 7,496,317 | B2 | 2/2009 | Igarashi et al. | |
| 7,522,872 | B2 * | 4/2009 | Fukuta | 399/390 |
| 7,869,735 | B2 | 1/2011 | Hattori | |
| 7,890,016 | B2 | 2/2011 | Ota | |
| 8,028,992 | B2 | 10/2011 | Terao | |
| 8,042,589 | B2 | 10/2011 | Hanada | |
| 8,045,880 | B2 * | 10/2011 | Hirose | 399/98 |
| 8,543,051 | B2 * | 9/2013 | Akatsuka et al. | 399/388 |
| 2001/0028813 | A1 | 10/2001 | Nishimura et al. | |
| 2001/0031154 | A1 | 10/2001 | Sato et al. | |
| 2003/0049043 | A1 | 3/2003 | Fuwazaki et al. | |
| 2005/0019073 | A1 | 1/2005 | Hattori | |
| 2007/0147875 | A1 | 6/2007 | Hattori | |
| 2009/0052935 | A1 | 2/2009 | Ota | |
| 2009/0095182 | A1 | 4/2009 | Hanada | |
| 2010/0052244 | A1 | 3/2010 | Terao | |
| 2012/0195622 | A1 * | 8/2012 | Shimizu | G03G 15/6558 399/98 |
| 2012/0251214 | A1 | 10/2012 | Shimizu | |

FOREIGN PATENT DOCUMENTS

| | | | |
|---|---|---|---|
| JP | 07-230225 | A | 8/1995 |
| JP | 2001-225981 | A | 8/2001 |
| JP | 2001-270631 | A | 10/2001 |
| JP | 2005-041652 | A | 2/2005 |
| JP | 2006-248652 | A | 9/2006 |
| JP | 2007-030996 | A | 2/2007 |
| JP | 2007-169024 | A | 7/2007 |
| JP | 2009-047911 | A | 3/2009 |
| JP | 2009-090582 | A | 4/2009 |
| JP | 2010-052907 | A | 3/2010 |
| JP | 2010-222107 | A | 10/2010 |
| JP | 2011-032057 | A | 2/2011 |
| JP | 2012-206805 | A | 10/2012 |

OTHER PUBLICATIONS

Apr. 29, 2014 Office Action issued in Chinese Patent Application No. 201210022036.0.

Non Final Office Action issued in U.S. Appl. No. 13/359,622 mailed May 13, 2013.

Feb. 16, 2016—(JP) Notification of Reasons for Rejection—App 2012-188598, Eng Tran.

* cited by examiner

IMAGE FORMING APPARATUS

CROSS-REFERENCE TO RELATED APPLICATION

This application claims priority under 35 U.S.C. §119 from Japanese Patent Application No. 2012-188598 filed on Aug. 29, 2012. The entire subject matter of the application is incorporated herein by reference.

BACKGROUND

1. Technical Field

Aspects of the present invention relate to an image forming apparatus having a paper particle removing unit which is arranged to face a register roller.

2. Prior Art

Conventionally, there has been known an image forming apparatus configured to have a paper particle removing unit which is used to remove paper particles on a printing sheet which is fed toward an image forming unit. Typically, such an image forming apparatus has a register roller which is arranged on an upstream side, in a sheet feed direction, with respect to the image forming unit, and the paper particle removing unit is provided to face the register roller.

In such a conventional image forming apparatus, the paper particle removing unit has a paper particle removing roller which, in association with the register roller, nips the printing sheet. When the printing sheet passes the nip between the register roller and the particle removing roller, the paper particles are removed by the particle removing roller.

SUMMARY

In the above-described configuration, it is preferable that a distance between a rotation axis of the register roller and a rotation axis of the particle removing roller can be changed in accordance with the thickness of the sheet passing the nip in order to improve accuracy in sheet feed.

In consideration of the above, aspects of the present invention is advantageous in that an improved image forming apparatus is provided, in which a distance between the rotation axes of the register roller and the paper particle removing roller can be changed.

According to aspects of the invention, there is provided an image forming apparatus, which has an image forming unit configured to form an images on a sheet, a sheet supplying unit configured supply a sheet to the image forming unit, a register roller arranged on a downstream, in a sheet feeding direction, of the sheet supplying unit and on an upstream, in the sheet feeding direction, of the image forming unit, and a paper particle removing unit which includes a paper particle removing roller arranged to face the register roller and collects paper particles on the sheet which is nipped between the register roller and the paper particle removing roller, a paper particle container configured such that the paper particles removed by the paper particle removing roller is accumulated therein, and an auger arranged inside the paper particle container. The paper particle removing roller, the paper particle container and the auger of the paper particle removing unit are configured to move between a contact position where the paper particle removing roller contacts the register roller and a spaced position where the paper particle removing roller is spaced from the register roller.

BRIEF DESCRIPTION OF THE ACCOMPANYING DRAWINGS

Figure 3:
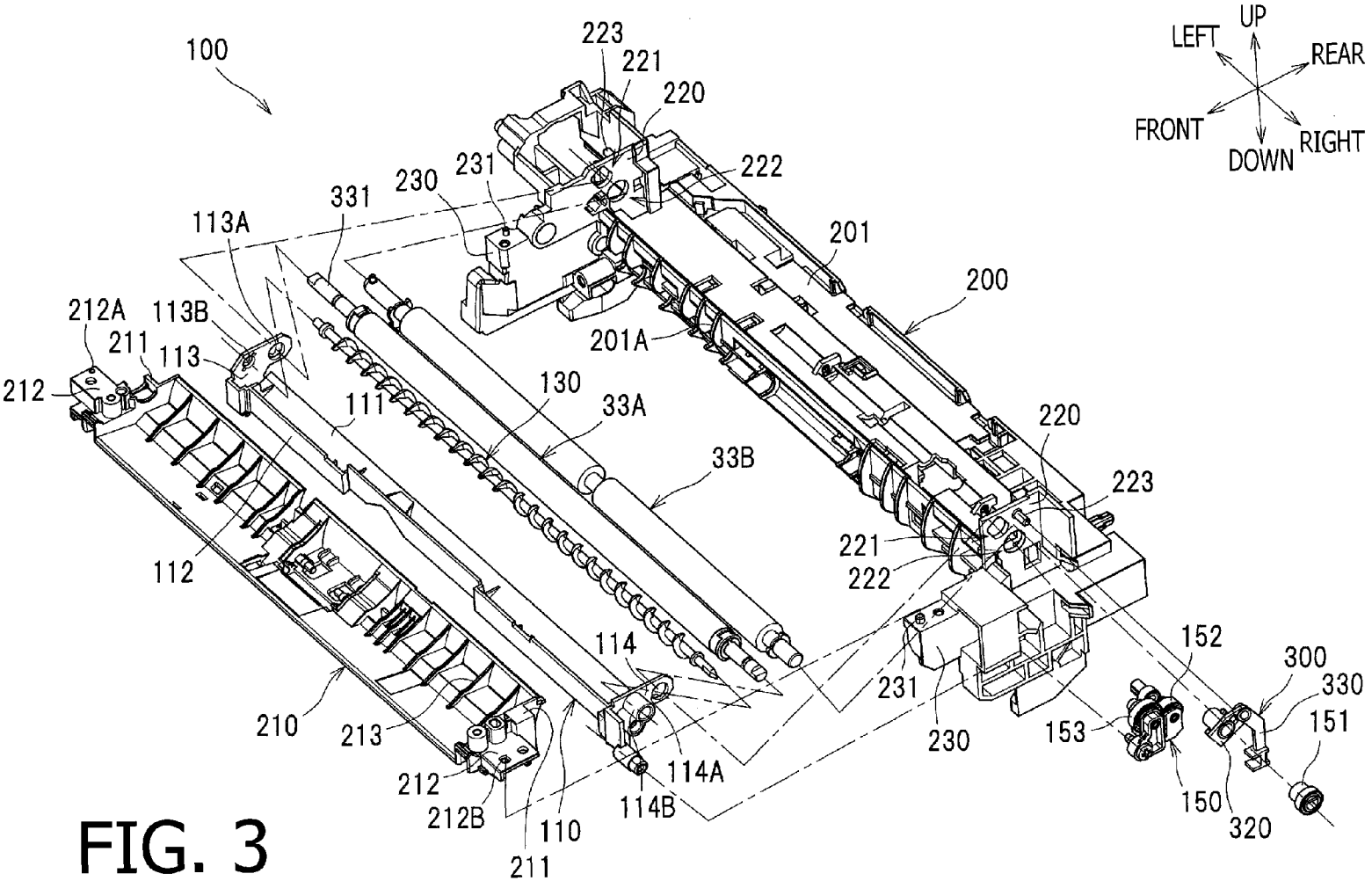

FIG. 3 an exploded perspective view showing a paper particle removing unit, a register roller, a holding frame, a link member and a second guide of the image forming apparatus according to the embodiment of the invention.

Figure 4A:
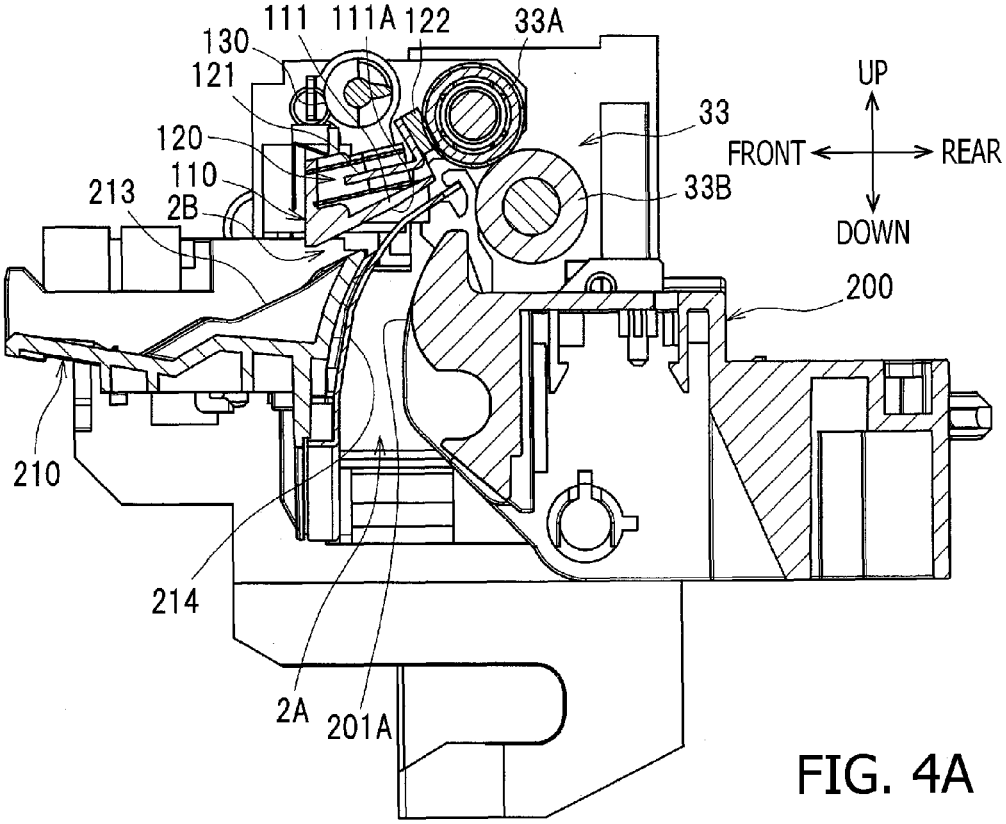

FIG. 4A is a cross-sectional side view showing components about the paper particle removing unit, and particularly showing a manual feed path formed by a first guide and the second guide.

Figure 4B:
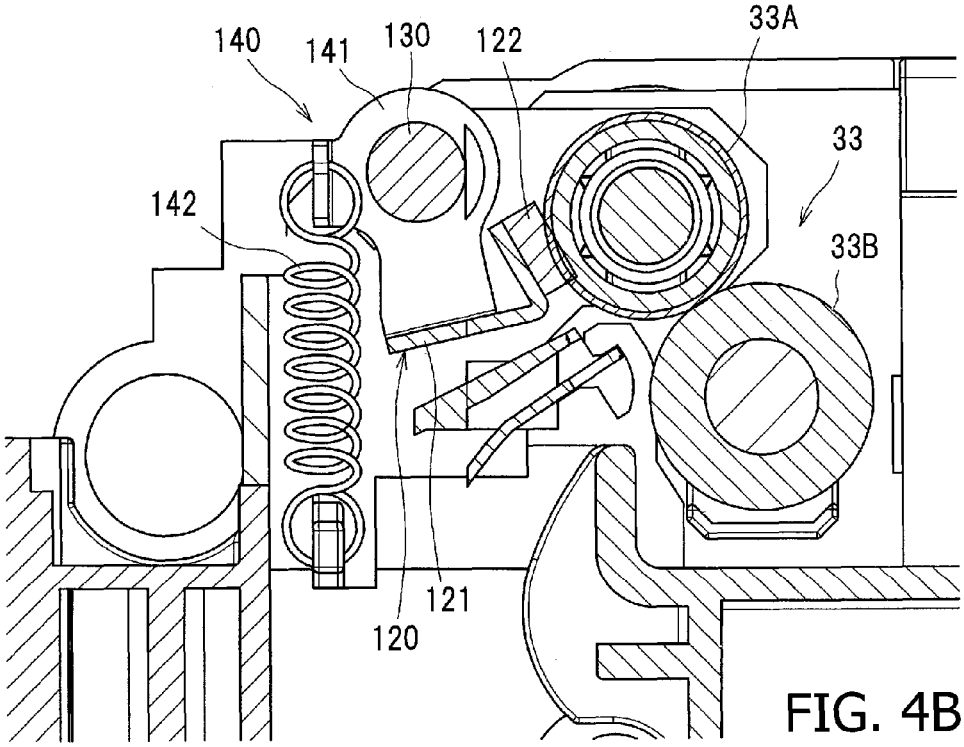

FIG. 4B is a cross-sectional side view showing of components about the paper particle removing unit, and particularly showing a scraping member and an urging member.

Figure 5:
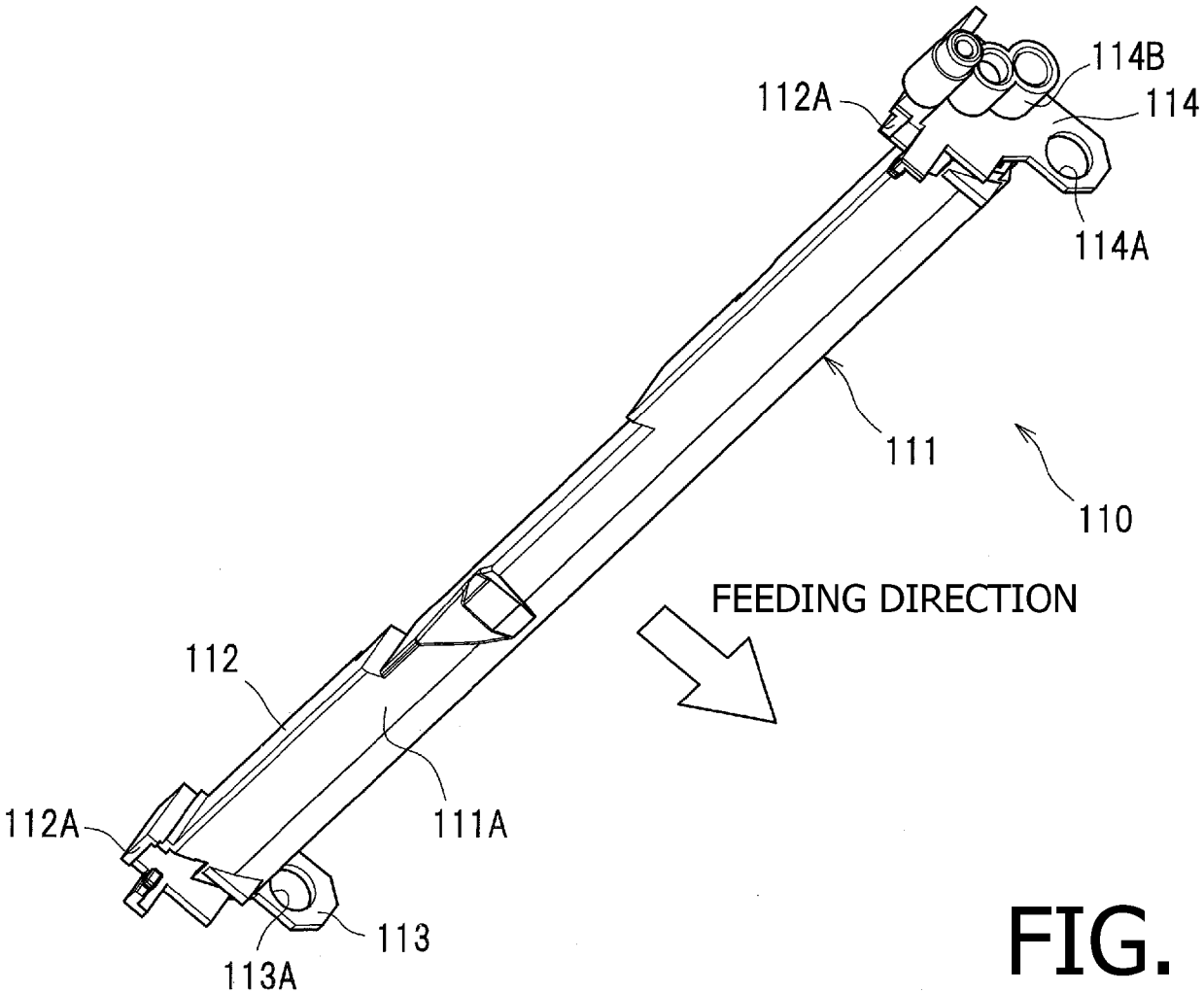

FIG. 5 is a perspective view showing the paper particle reservoir viewed from below.

Figure 6:
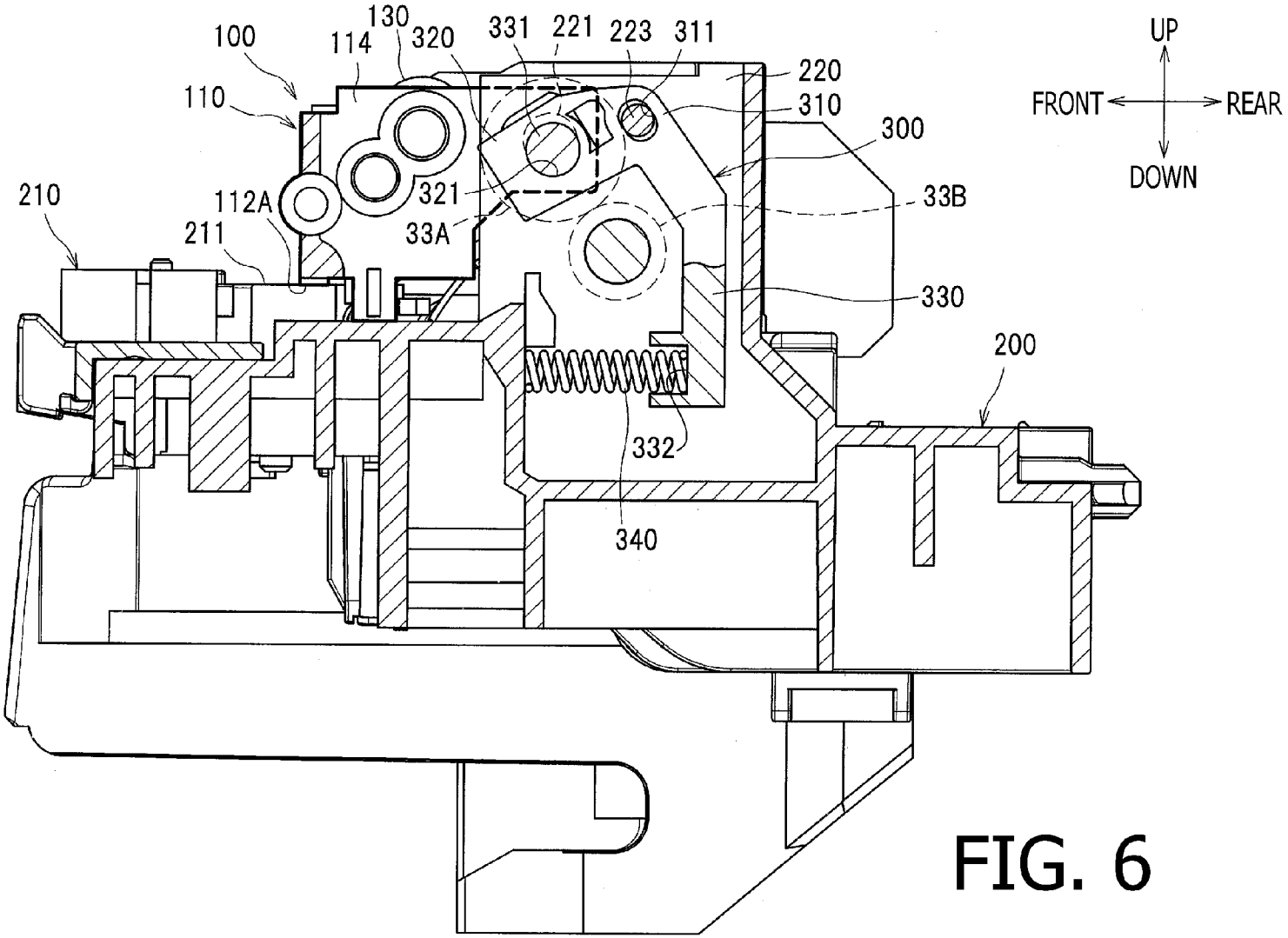

FIG. 6 is a cross-sectional side view showing a position of the link member when the paper particle removing unit is located at a contact position.

Figure 7:
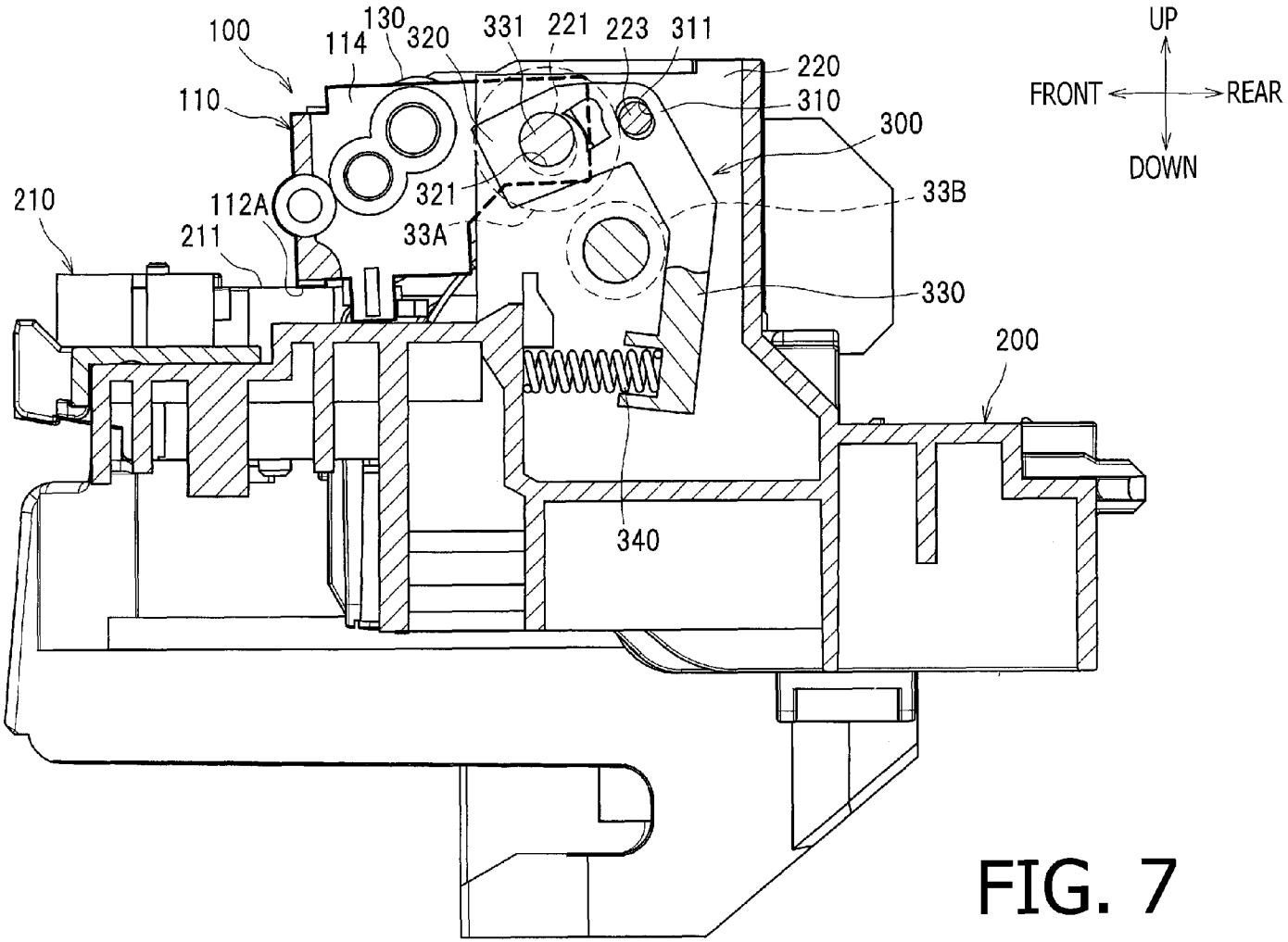

FIG. 7 is a cross-sectional side view showing a position of the link member when the paper particle removing unit is located at a spaced position.

DESCRIPTION OF THE EMBODIMENT

Hereinafter, an exemplary embodiment according to aspects of the invention will be described with reference to the accompanying drawing. Initially, an overall configuration of a color printer 1 according to an exemplary embodiment will be described, and then characteristic features thereof will be described in detail.

In the following description, directions are described with respect to a user who uses the color printer 1. For example, in FIG. 1, a left-hand side is a "front side", a right-hand side is a "rear side", a near side is a "right side", a far side is a "left side", and up and down sides are "up and down sides" of the color printer 1.

<Overall Configuration of Color Printer>

Figure 1:
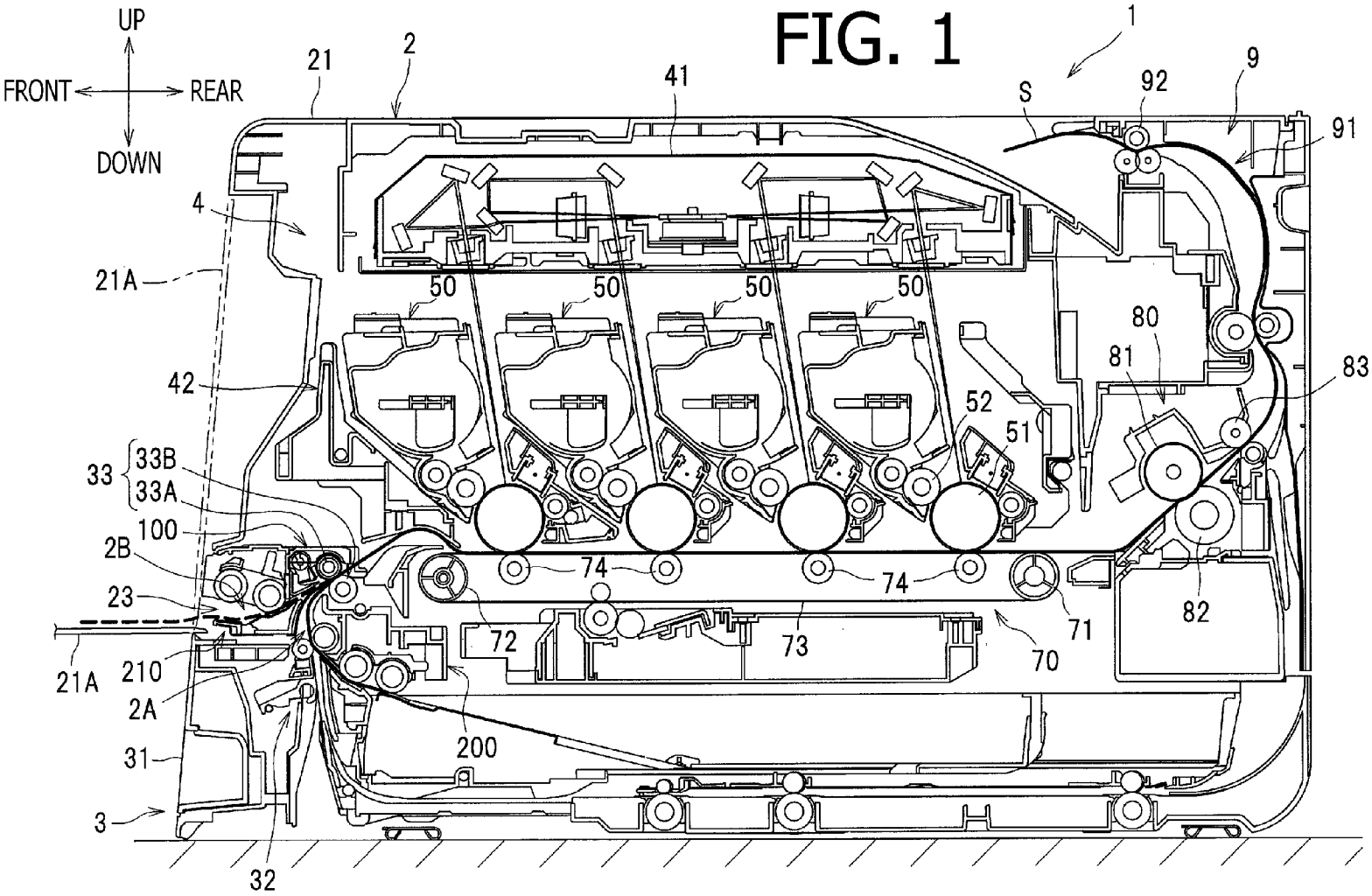
FIG. 1 is a cross-sectional side view schematically showing a configuration of a color printer according to an embodiment of the invention.

The color printer 1 has, inside a casing 2, a sheet supplying unit 3 that supplies sheets S, an image forming unit 4 that forms images on the sheets S supplied from the sheet supplying unit 3, and a sheet ejection unit 9 that ejects the sheets S on which images have been formed, as shown in FIG. 1.

Figure 2:
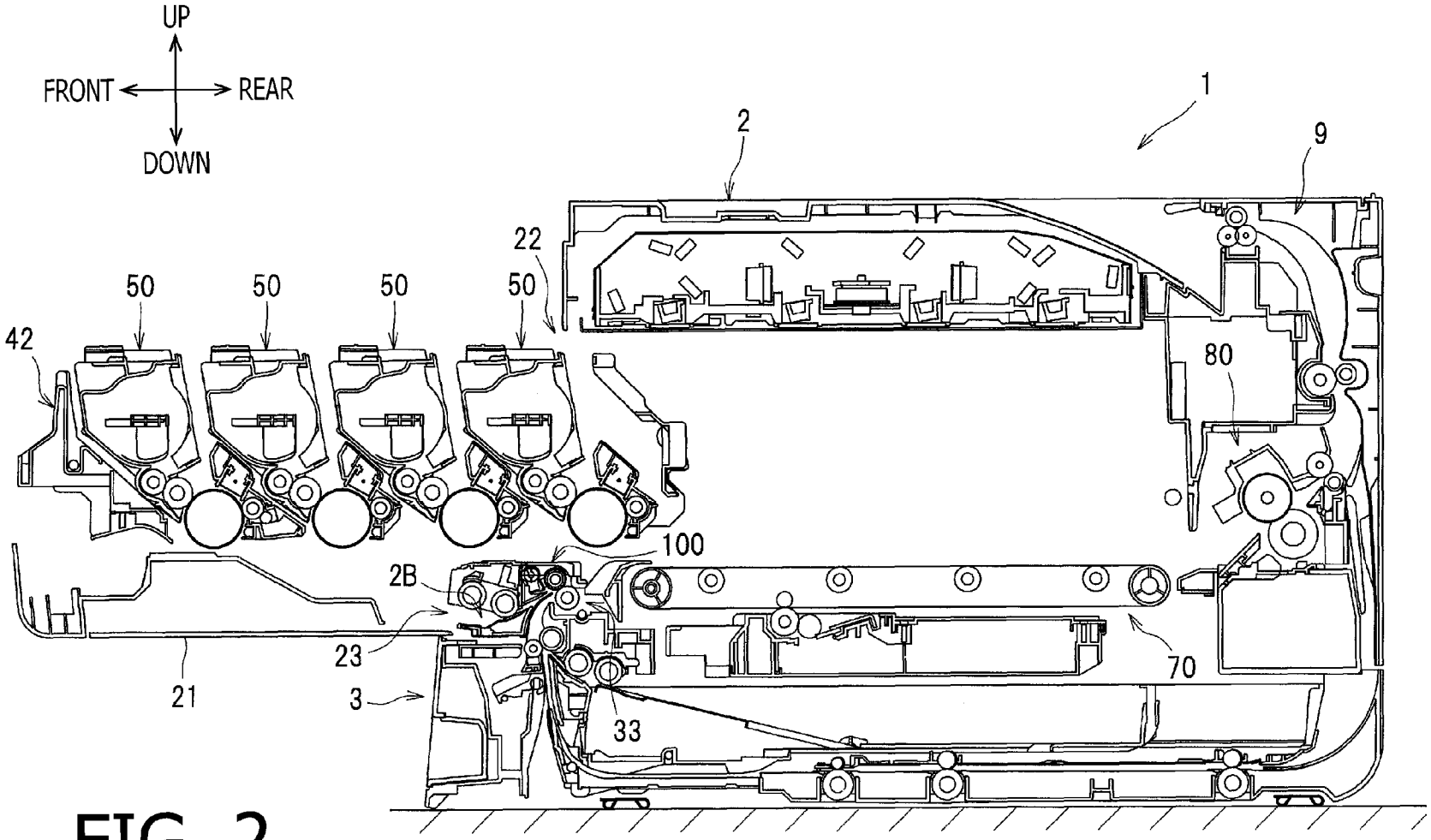
FIG. 2 is a cross-sectional side view schematically showing a state where a drawable member is drawn from a main body of the image aiming apparatus.

As shown in FIG. 2, an opening 22 and a manual feed slit 23 are formed on a front face of the casing 2.

The opening 22 is formed such that an upper end is higher than a process cartridge 50, which will be described later, and a lower end is at substantially the same height of an upper end of a paper particle removing unit 100. The opening 22 is covered with a front cover 21 secured to the casing 2, and is exposed to outside when the front cover 21 is opened.

The manual feed slit 23 is formed at a position lower than the opening 22. The manual feed slit 23 is exposed to outside when a manual feed tray 21A, which is a part of the front cover 21, is opened. A sheet S inserted in the manual feed slit 23 is fed through a manual feed path 2B defined in the casing 2 toward a pair of register rollers 33.

The sheet supplying unit 3 has a sheet supplying tray 31 accommodating the sheets S, and a sheet feeding device 32 configured to feed the sheets S from the sheet supplying tray 31 to the image forming unit 4.

In the sheet supplying unit 3, the sheets S accommodated in the sheet supplying tray 31 are fed upward one by one as separated by the sheet feeding device 32. Each sheet S thus fed by the sheet feeding device 32 passes through a nip between the pair of register rollers 33 arranged on a sheet feed path 2A connecting the sheet supplying unit 3 and the image forming unit 4 (at a position on a downstream side with respect to the sheet supplying unit 3 in the sheet feeding direction, and on an upstream side with respect to the image forming unit 4) and fed to the image forming unit 4.

The pair of register rollers 33 stops the sheet S temporarily as the leading end of the sheet S contacts the pair of register rollers 33 before feeding the sheet S toward the image forming unit 4. By temporarily stopping the feeding of the sheet S, a skewing state of the sheet S is prevented/corrected and image formation timing on the sheet S is adjusted.

The pair of register rollers 33 includes a paper particle removing roller 33A to which a driving force is transmitted from a motor (not shown), and a register roller 33B rotatably supported by the casing 2.

The image forming unit 4 includes a scanner unit 41, four process cartridges 50, a drawable unit 42, a transferring unit 70 and a fixing unit 80.

The scanner unit 41 is provided on an upper portion inside the casing 2. The scanner unit 41 has a well-known configuration and includes a laser light source, a polygonal mirror, a plurality of lenses and mirrors. A laser beam emitted from the laser source in accordance with image data is deflected by the polygonal mirror and other mirrors, and passes through the lenses so that a beam spot scans on a surface of the photoconductive drum 51 at a high speed.

The process cartridges 50 are arranged in a front-and-rear direction, between the sheet supplying tray 31 and the scanner unit 41. Each of the process cartridges 50 has a well-known configuration and includes a well-known charger, a developing roller 52, a toner container and the like.

The four process cartridges 40 are detachably mounted on the drawable unit 42. The drawable unit 42 can be drawn outside the casing 2 through the opening 22, which is exposed to outside when the front cover 21 is opened. The drawable unit 42 passes above the paper particle removing unit 100 when drawn from the casing 2 (see FIG. 2).

The transfer units 70 are arranged between the sheet supplying unit 3 and the process cartridges 50, respectively, each having a driving roller 71, a driven roller 72, a feed belt 73 and a transfer roller 74.

The driving roller 71 and the driven roller 72 are arranged in parallel in the front-and-rear direction with a certain space therebetween. Through the space, the feed belt 73, which is an endless belt, extends. An outer surface of the feed belt 73 contacts the photoconductive drums 51. On an inner surface of the feed belt 73, transfer rollers 74 are provided at positions corresponding to the photoconductive drums 51 so that the feed belt 73 is nipped between the photoconductive drums 51 and the transfer rollers 74, respectively. To each of transfer rollers 74, a transfer bias current is applied by constant current control when an image is transferred from the photoconductive drum to a sheet fed by the feed belt 73.

The fixing unit 80 is arranged on a rear side with respect to the process cartridges 50, and has a heat roller 81 and a pressure roller 82 which faces the heat roller 81 and urged toward the heat roller 81. On a downstream side with respect to the heat roller 81, a feed roller 83 configured to feed the sheet S toward the ejection unit 9 is arranged.

In the image forming unit 4 configured as above, a circumferential surface of each of the photoconductive drums 51 is uniformly charged by the charging units, then the circumferential surfaces of the photoconductive drums 51 are exposed to light emitted from the scanner unit 41. Then, an electric potential of the exposed portions of the circumferential surface of the photoconductive drums 51 is lowered, so that an electrostatic latent image is formed on each of the photoconductive drums 51. Thereafter, by the developing rollers 52, toner in the toner containers is supplied onto the electrostatic latent images on the photoconductive drums 51, respectively (i.e., toner images are formed).

Next, the sheet S supplied onto the feed belt 73 is fed to pass through a space between each photoconductive drum 51 and the corresponding transfer roller 74, the toner image formed on each photoconductive drum 51 is transferred onto the sheet S. Thereafter, as the sheet S passes through the nip between the heat roller 81 and the pressure roller 82, the toner image transferred on the sheet S is fixed thereon. As above, an image is formed on the sheet S. The sheet S on which the image is formed thereon is fed, by the feed roller 83, to a feed path 91 of the ejection unit 9, and ejected outside the casing 2 by the ejection roller 92.

<Configuration Around the Paper Particle Removing Unit>

The paper particle removing unit 100 is arranged on a front side portion of the casing 2 as shown in FIG. 1. Around the paper particle removing unit 100 inside the casing 2, a main frame 200, a second guide 210 composed by the feed path 2A, the manual feed path 2B, the register roller 33B, and a link member 300 which restricts movement of the paper particle removing unit 100 and urges the paper particle roller 33A toward the register roller 33B.

The casing 2 has the main frame 200 and the second guide 210. The main frame 200 supports the register roller 33B, the paper particle removing unit 100 and the link member 300.

As shown in FIG. 3, the main frame 200 has a frame body 201 which extends in the axial direction of the paper particle removing roller 33A or the register roller 33B (i.e., the right-and-left direction). The frame body 201 has a guide surface 201A which forms a rear surface of the feed path 2A.

The main frame 200 is configured such that, on both end portions of the frame body 201 in the right-and-left direction there are, a pair of supporting plates 220 which supports the paper particle removing unit 100 and the register roller 33B, and a pair of fixing portions 230 which support the second guide 210.

Each of the pair of supporting plates 220 extends from the above to front side of the frame body 201.

Each supporting plate 220 has a first opening 222 which is a through opening on a rear side portion thereof. On an obliquely upper front portion with respect to the first opening 222, an elongated hole 221 extending toward the first opening 222 is formed. The elongated hole 221 is a hole with which the shaft 331 of the paper particle removing roller 33A engages. The elongated hole 221 is formed such that when the shaft 331 of the paper particle removing roller 33A contacts an end of the elongated hole 221 on the first opening 222 side, the paper particle removing roller 33A contacts the register roller 33B. On a rear side portion of the supporting plate 220, supporting shafts 223, which protrude outward from the supporting plate 220 on the right and left directions, respectively, are provided.

The fixing portion 230 extends from outside, in the right-and-left direction of the guide surface 201A toward the front side, and the tip portion is protruded frontward farther than the supporting plate 220. On an upper surface of the tip portion of the fixing portion 230, a protruded part 231 protruding upward is formed.

The second guide 210 is arranged on the front side of the main body frame 220 as shown in FIG. 4A, and has a first surface 213 forming the manual insertion path 2B.

The first surface 213 is formed on the upper surface of the second guide 210, and extends more toward a space between the paper particle removing roller 33A and the register roller 33B at a position closer to the rear side.

The second surface 214 is formed on a rear surface of the second guide 210, and extends rearward more toward a position between the paper particle removing roller 33A and the register roller 33B. The second surface 214 is arranged to face the guide surface 201A of the main frame 200, and defines, in association with the guide surface 201A, the feed path 2A.

The second guide 210 has a pair of supporting parts 211 and a pair of fixation parts 212 on outside, in the right-and-left direction, of each of the first surface 213 and the second surface 214.

On upper surfaces of the pair of supporting parts 211 support a paper particle containing unit 110.

The pair of fixation parts 212 are formed as planar parts extending in the right-and-left direction. On the left fixation part 212, a hole 212A is formed, while on the right fixation unit 212, an elongated hole 212B is formed.

The thus configured second guide 210 positioned with respect to the main frame 200 as the hole 212A and the elongated hole 212B are engaged with projections 231 provided to the fixing parts 230 of the main frame 200.

The register roller 33B is a roller extending in the right-and-left direction, and having a rubber layer on its outer surface. The register roller 33B is supported by the pair of supporting plates 220 of the main frame 200 as both ends portions are fitted in the first openings 222 of the supporting plates 220.

The paper removing unit 100 is arranged to face the register roller 33B and configured to remove paper particles from the sheet S nipped between the pair of register rollers 33.

The paper particle removing unit 100 has a paper particle removing roller 33A and the paper particle container 110 collecting and containing the paper particles removed (collected) by the paper particle removing roller 33A. Specifically, the paper particle removing unit 100 has, in the paper particle container 110, a scraping member 120 (see FIG. 4A) for scraping the paper particles from the paper particle removing roller 33A, an auger 130 for spreading the scraped paper particles inside the container 110, and the pressing member 140 (see FIG. 4B) configured to urge the scraping member 120 toward the paper particle removing roller 33A. Further, the paper particle container 110 accommodates a gear train 150 which transmits a driving force (i.e., a rotation force) of the paper removing roller 33A to the auger 130. It is noted that the auger 130 has a spiral configuration according to the exemplary embodiment.

The paper particle removing roller 33A extends in the right-and-left direction, and arranged to face the register roller 33B. The paper particle removing roller 33A is configured such that an outer circumferential surface of the shaft 331 made by metal is coated with fluorine resin. As the paper particle removing roller 33A slidably contacts the scraping member 120, the circumferential surface is charged by friction, thereby attracting (collecting) the paper particles from the sheet nipped between the register roller 33B and the paper particle removing roller 33A.

The paper particle removing roller 33A is supported by the paper particle container 110, and right-and-left side end portions of the shaft 331 extend outside the paper particle container 110.

An input gear, which is connected with a motor, is coupled to the left-side end of the paper particle removing roller 33A through a universal joint. With this configuration, even if the paper particle roller 33A displaced upward when the paper particle removing roller 33A and the register roller 33B sandwich the sheet S, the displacement would not affect the function of the input gear. Further, a first gear 151 of the gear train 150 is fixed to the right-side end of the paper particle removing roller 33A.

As described above, the paper particle container 110 is for containing the paper particles collected by the paper particle removing roller 33A. The paper particle container 110 has a bottom wall 111, a front wall 112 and a pair of right and left side walls 114 and 113, the walls 111, 112, 113 and 114 defining a space collecting the paper particles. There is also provided a lid member which covers the upper part of the space defined by the walls 111, 112, 113 and 114. However, in FIGS. 3-7, the lid is not depicted in order to show the configuration of the paper particle container 110 clearly.

The bottom wall 111 is inclined, as shown in FIG. 5, such that at position from the front side to the rear side, that is, on the downstream side along the feeding direction of the sheet S, the bottom wall 111 inclines upward (i.e., extends toward a nip of the pair of register rollers 33). The pair of right-and-left walls 114 and 113 extend upward from end positions, in the axial direction of the paper particle removing roller 33A, of the bottom wall 111, extends in the downstream direction, and protrude, from the bottom wall 111, in the downstream direction.

The paper particle container 110 is configured to support the paper particle removing roller 33A and the auger 130, as shown in FIG. 3. Specifically, the second openings 114A and 113A in which the shaft 331 of the paper particle removing roller 33A are inserted are formed on the right and left walls 114 and 113, respectively, at end portions thereof in the downstream side with respect to the sheet feed direction (i.e., portions protruded on the downstream side in the sheet feed direction with respect to the bottom wall 111). Further, on the left side wall 113, on the front side of the second opening 113A, the through hole 113B is formed. Further, on the right side wall 114, a bearing 114B for receiving the shaft of the auger is formed on the front side of the second opening 114A. The bearing 114B is formed to have a substantially cylindrical shape protruding outward from the right-side wall 114. The right side end portion of the auger 130 can be inserted in the bearing 114B.

The paper container 110 protrudes, from the front wall 112, toward the upstream side in the feeding direction (see FIG. 5), and has contact parts 112A, which are arranged at axial end portions at position closely upstream side portion of the paper particle container 110 (on the front wall 112), protruding downward.

The bottom wall 111 of the paper particle container 110 is formed such that a lower surface thereof serves as a first guide 111A which faces the first surface 213 of the second guide 210 to define an upper side of the manual feed path 2B. The sheet S supplied through the manual feed path 2B is guided by the first guide 111A toward the pair of register rollers 33 (or the register roller 33B).

The scraping member 120 includes, as shown in FIG. 4B, the supporting member 121 and the scraping part 122.

The supporting member 121 is configured/arranged such that the urging member 122 is made of, for example, sponge is fixed at the tip of the supporting member 121, and the scraping part 122 contacts the paper particle removing roller 33A from the upstream side in the feeding direction. The supporting member 121 is urged such that the scraping part 122 is press-contacted on the surface of the paper particle removing roller 33A by the pressing member 140 provided inside the paper particle container 110.

Specifically, the pressing member 140 includes a rotatable member 141 on which the supporting member 121 is fixed, and a spring 142 urging the rotatable member 141. The rotatable member 141 is pivoted by the right-and-left side end portions of the auger 130, on the upstream side, in the feeding direction, of the paper particle removing roller 33A, and a proximal end part of the supporting member 121 of the scraping member 120 is connected on the lower end thereof. The spring 142 engages with the rotatable member 141, and urges the rotatable member 141 so that the rotatable member 141 rotates in a counterclockwise direction in FIG. 4B.

In the exemplary embodiment, the supporting member 121 of the scraping member 120 and the rotatable member 141 of the pressing member 140 are formed integrally.

The auger 130 is configured to convey the paper particles scraped by the scraping member 120 from a central part, in the axial direction, toward end portions. The auger 130 is arranged at position closer to a position where the paper removing roller 33A and the scraping part 122 contact, and above the bottom wall 111 of the paper particle container 110.

The auger 130 is rotatably supported by the right and left walls 114 and 113 of the paper particle container 110. That is, the auger 130 is configured such that the left-side end portion is inserted n the through hole 113B, and the right-side end portion is received by the bearing 114B as shown in FIG. 3.

The gear train 150 includes, in addition to the first gear 151 which is fixed at the right-side end of the paper particle removing roller 33A, a second gear 152 fixed at the right-side end of the auger 130, and an intermediate gear 153 engaging with the first gear 151 and the second gear 152.

The second gear 152 is rotatably supported by the right wall 114 via the bearing 114B. Further, the intermediate gear 153 is fitted in a bearing formed on the right wall 114 and rotatably supported thereby. The first gear 151 is also supported by the right wall 114 via the paper particle removing roller 33A.

The paper particle removing unit 100 is configured such that the right and left end portions of the shaft 331 of the paper particle removing roller 33A protruded from the paper particle container 110 engage in the elongated holes 221 of the supporting plates 220, thereby the rear end portion of the paper particle removing unit 110 is supported by the main frame 200. Further, as the contact part 112A directly contacts the supporting part 211 of the second guide 210, the frond side portion of the paper particle removing unit 100 is supported by the second guide 210, and the first guide 111A is positioned with respect to the second guide 210.

As the shaft 331 of the paper particle removing roller 33A moves as being guided by the elongated holes 221, the paper removing roller 33A can be movable between a contact position where the paper particle removing roller 33A contacts the register roller 33B (see FIG. 6) and a spaced position where the paper particle removing roller 33A is spaced from the register roller 33B (see FIG. 7).

The link member 300 urges the paper particle removing roller 33A toward the register roller 33B, and is rotatably supported by the main frame 200.

Specifically, the link member 300 has pivoted parts 310 to be pivoted by the supporting plates 220 of the main frame 200 and a first arm portion 320 and a second arm portion 330 which extend from the pivoted parts 310, respectively. The link member 300 has a substantially L-shaped side view.

The pivoted parts 310 have holes 311 in which the supporting shafts 223 of the supporting plates 223 are fitted.

The first arm portion 320 is formed to extend frontward, that is, from the pivoted portion 310 toward the paper particle removing roller 33A side, and in a direction which is substantially orthogonal to a direction in which the elongated hole 211 extends.

The second arm portion 330 extends in a direction different from the direction in which the first arm portion 320 extends, that is, the second arm portion 330 extends downwardly.

The second arm 330 is urged by a compressed spring 340 such that the first arm member 320 urges the paper particle removing roller 33A toward the register roller 33B.

Specifically, one end of the compressed spring 340 is supported by the main frame 200, while the other end of the compressed spring 340 engages with an engaging part 332 which is a tip end portion of the second arm portion 330. As the compressed spring 340 urges the second arm portion 330 in the rearward direction, thereby the link member 300 is urged to rotate counterclockwise, and the first arm portion 320 is urged downward.

When printing is executed, the sheet S supplied from the sheet feed tray 31 or the manual feed slit 32 is fed toward the register rollers 33 through the feed path 2A or manual feed path 2B. When the leading end of the sheet S abuts the register rollers 33 and the position of the leading end of the sheet S is restricted, the paper particle removing roller 33A and the register roller 33B are rotated. At this stage, the rotational driving force is transmitted from the paper particle removing roller 33A to the auger 130 through the gear train 150, the auger 130 also rotates (see FIG. 3).

When the sheet S passes through the nip between the pair of the register rollers 33, the paper particle removing roller 33A collects the paper particles attached on the sheet S. The paper particles collected by the paper particle removing roller 33A is scraped by the scraping member 120 and fall down inside the paper particle container 110 with being spread in the axial direction by the auger 130, and collected therein.

When a normal sheet having a normal thickness is used as the sheet S and such a sheet S is nipped between the paper particle removing roller 33A and the register roller 33B, the paper particle removing unit 100 is located at the contact position as shown in FIG. 6.

When a relatively thick sheet is used as the sheet S and such a sheet S is inserted in the nip between the paper particle removing roller 33A and the register roller 33B, the paper particle removing roller 33A is lifted by the sheet S and the spaced from the register roller 33B as guided by the elongated holes 221 as shown in FIG. 7.

In this case, the downstream side portion (i.e., the paper particle removing roller 33A side) of the paper particle container 110 is lifted with the contact portion 112A provided on the upstream side contacting the supporting parts 211 of the second guide 210. That is, the paper particle removing unit 100 is rotated, about the contact portions 112A, to the spaced position.

As above, the color printer 1 is configured such that the paper particle removing unit 100 is movable between the contact position and the spaced position. Therefore, depending on the thickness of the sheet S, the distance between the axes of the register roller 33B and the paper particle removing roller 33A are variable. With this configuration, precision in feeding the sheet S of the pair of register rollers 33 can be ensured.

Further, the surface of the paper particle removing roller 33A is coated with the fluorine resin, and the surface of the register roller 33B is coated with the rubber. Therefore, frictional force of the register roller 33B with respect to the sheet S is larger than that of the paper particle removing roller 33A. With such a configuration, if the register roller 33B inclines, the leading end of the sheet S abutting the register roller 33B also inclines. According to the exemplary embodiment, however, the paper particle removing roller 33A, which has a smaller frictional force with respect the sheet S is moved in order to change a distance between the axes of the register roller 33B and the paper particle removing roller 33A and the register roller 33B is stayed unmoved. Therefore, precision in feeding the sheet S by the register roller 33B is ensured.

Since the second gear 152 and the intermediate gear 153 of the gear train 150 are supported by the paper particle container 110 which supports the paper particle removing roller 33A, although the paper particle removing unit 100 (i.e., the paper particle removing roller 33A) moves between the contact position and the spaced position, the distance between the axes of the gears of the gear train 150 is substantially unchanged. Therefore, it is ensured that the rotational driving force of the paper particle removing roller 33A can be transmitted to the auger 130.

Since the paper particle removing unit 100 is rotatable about the contact parts 112A arranged on the upstream side with respect to the paper particle container 110, the position of the upstream side end of the first guide 111A, which forms the manual insertion path 2B, changes little. Therefore, the sheet S can be fed well to a portion between the first guide 111A and the second guide 210.

After the thick sheet has passed through the nip between the register roller 33B and the paper particle removing roller 33A, the paper particle removing roller 33A moves, by the function of the link member 300, as guided by the elongated holes 221 to approach the register roller 33B and returns to the contact position.

The image processing device according to the exemplary embodiment is configured such that the drawable member 42 can be drawn, passing above the paper particle removing unit 100, from the casing 2. Since the link member 300 is provided to the supporting plates 220 which are arranged outside, in the axial direction, of the paper particle removing roller 33A, the drawable member 42 can be configured to pass immediately above the paper particle removing unit 100. Therefore, for example, in comparison with a case where the link member is arranged above the paper particle removing roller 33A and the paper particle removing roller 33A is urged toward the register roller 33B, the casing can be downsized at least in the up-and-down direction.

It is noted that the above-described embodiment is an exemplary embodiment, and the present invention should not be limited to the configurations of the exemplary embodiment. Rather, the configuration could be modified in various ways without departing the scope of the invention.

In the exemplary embodiment, the first guide 111A is configured to guide the sheet S supplied from the manual feed slit 23 to the register roller 33B. The invention needs not be limited to such a configuration. For example, the first guide 111A may be configured such that the first guide 111A forms a path connecting the sheet supplying unit 3 and the image forming unit 4, the guides the sheet S supplied from the sheet feed tray 31 toward the register roller 33B.

In the exemplary embodiment, the pressing member 140 includes the rotatable member 141 and the spring 142. The invention needs not be limited to such a configuration. For example, the supporting member 121 of the scraping member 120 may be formed of a plate spring to serve as the urging member. In such a configuration, the scraping part 122 is press-contacted to the paper particle removing roller 33A with the elastic force of the plate spring.

In the exemplary embodiment, the compressed spring 340 is used as the urging member. The invention needs not be limited to such a configuration. That is, the urging member may be a torsion spring or the like.

In the exemplary embodiment, the description is made such that the recording sheet may be thick sheets, post cards, think sheets, and the like. The invention needs not be limited to such a configuration, and the sheet may be an OHP (overhead projector) sheet.

In the exemplary embodiment, the invention is applied to the color printer 1. However, the invention needs not be limited to the configuration described as the exemplary embodiment, and can be applied to other image forming devices such as a copier, a multi-function peripheral and the like.

What is claimed is:

1. An image forming apparatus, comprising:

an image forming unit configured to form an image on a sheet;

a sheet supplying unit configured to supply a sheet to the image forming unit;

a register roller arranged downstream, in a sheet feeding direction, of the sheet supplying unit and upstream, in the sheet feeding direction, of the image forming unit;

a paper particle removing unit includes:

a paper particle removing roller arranged to face the register roller and configured to collect paper particles on the sheet which is nipped between the register roller and the paper particle removing roller;

a paper particle container configured such that the paper particles removed by the paper particle removing roller are accumulated in the paper particle container, the paper particle container having a first guide configured to guide the sheet toward the register roller; and an auger arranged inside the paper particle container;

a second guide arranged to face the first guide, wherein the second guide, in association with the first guide, defines a sheet feed path;

a frame configured to support the register roller and the paper particle removing roller; and a cover configured to pivot between an open position and a closed position, the cover being separate from the frame, wherein the paper particle removing roller, the paper particle container and the auger included in the paper particle removing unit are configured to be movable together between a contact position where the paper particle removing roller contacts the register roller and a spaced position where the paper particle removing roller is spaced from the register roller, wherein the paper particle container further includes a contact portion projecting toward the second guide and configured to contact the second guide;

an upstream side wall arranged on an upstream side, in a direction where the sheet is fed as guided by the first guide;

a front wall; and contact parts provided to both ends, in a width direction, of the front wall, the contact parts being arranged on an upstream side, in the direction where the sheet is fed, with respect to the front wall, and wherein the paper particle removing unit is configured to rotate about the contact portion, the paper particle removing unit being movable between the contact position and the spaced position as it rotates about the contact portion.

2. The image forming apparatus according to claim 1, wherein the paper particle container includes a bottom wall which serves the first guide.

3. The image forming apparatus according to claim 1, wherein the first guide guides a sheet, which is supplied from an opening formed on a casing of the image forming apparatus to the register roller.

4. The image forming apparatus according to claim 1, wherein the paper particle removing unit includes:

wall parts arranged to face each other with the paper particle removing roller located therebetween and extending in a direction orthogonal to an axis of the paper particle removing roller to define the paper particle container; and a gear train configured to transmit a rotational force of the paper particle removing roller to the auger, wherein the wall parts support the paper particle removing roller, the auger and the gear train.

5. The image forming apparatus according to claim 1, wherein the paper particle removing unit includes:

a scraping member configured to contact the paper particle removing roller to scrape the paper particle adhered on the paper particle removing roller; and a pressing member configured to make the scraping member press-contact the paper particle removing roller.

6. The image forming apparatus according to claim 1, wherein the paper particle container rotatably supports the auger and the paper part removing roller.

7. The image forming apparatus according to claim 6, wherein the paper particle container is rotatable with respect to the frame.

8. The image forming apparatus according to claim 1, wherein the register roller and the paper particle removing roller remain stationary while the cover moves from the open position to the closed position.

9. The image forming apparatus according to claim 1, wherein the frame remains stationary while the cover moves from the open position to the closed position.

* * * * *